United States Patent [19]

Csekes

[11] 4,452,445

[45] Jun. 5, 1984

[54] LOADING DEVICE FOR PHYSIOLOGICAL EXAMINATIONS

[75] Inventor: József Csekes, Debrecen, Hungary

[73] Assignee: Medicor Muvek, Budapest, Hungary

[21] Appl. No.: 371,301

[22] PCT Filed: Aug. 28, 1981

[86] PCT No.: PCT/HU81/00034

§ 371 Date: Apr. 12, 1982

§ 102(e) Date: Apr. 12, 1982

[87] PCT Pub. No.: WO82/00769

PCT Pub. Date: Mar. 18, 1982

[30] Foreign Application Priority Data

Aug. 29, 1980 [HU] Hungary ..... 2131/80

[51] Int. Cl.[3] ..... A63B 21/24; H02K 7/10

[52] U.S. Cl. ..... 272/73; 272/129; 310/75 B

[58] Field of Search ..... 272/73, 129; 73/379; 128/25 R, 707; 310/75 B

[56] References Cited

U.S. PATENT DOCUMENTS 2,195,328 3/1940 Eaton ..... 310/75 B
4,084,810 4/1978 Forsman ..... 272/73

FOREIGN PATENT DOCUMENTS 244166 5/1969 U.S.S.R. ..... 272/73

*Primary Examiner*—Robert A. Hafer
*Assistant Examiner*—Arnold W. Kramer
*Attorney, Agent, or Firm*—Anthony H. Handal

[57] ABSTRACT

Physiological loading device having a central pedal drive shaft 5 which drives via a freewheel a drum-shaped wheel 21 with inner gearing to which are advantageously coupled three follower gears. These drive, via gearing, an inner shaft 10 which is arranged around the drive shaft. The rotor of an electric rotational motor is arranged at the inner shaft, the rotor being surrounded by an armature 4 with poly-phase winding. The armature 4 is located between an inner and an outer housing part. The rotor windings are supplied with energizing current from sliding contacts, and the armature windings are connected to a braking unit.

3 Claims, 2 Drawing Figures

LOADING DEVICE FOR PHYSIOLOGICAL EXAMINATIONS

The invention relates to a loading or stress-inducing device for physiological examinations, which device has a shaft driven by the person to be examined, a drive with a free wheel, a transmission gear, a fly wheel mass which is coupled with the acceleration side of the transmission gear, a follower electric motor in brake operation and to which are connected externally electrical control and loading circuits.

In a physician's practice increasingly examination methods are used in which not only static but also dynamic values are determined under load. The dynamic values play an important role in the prophylatic and rehabilitation diagnostics, as well as in general, sports related or work related medical diagnostics. The load or stress is advantageously produced by pedaling or bicycling which subjects old or young or experienced as well as inexperienced patients to the same load. The bicycling can be accomplished either lying down or standing up.

The general demands made upon loading or stress-inducing systems are: variable loading, no harmful effects, interruption at random and, they must be physiological and reproducible.

A special advantage is a feedback if the loading system can be controlled by the functional parameters, such as breathing, EKG, blood pressure, etc. On the basis of present knowledge the following technical solutions are used for producing the load: eddy current brake, electric motor in brake operation, a dynamo-motor-tachometer system, scale motor, mechanical braking, etc. The disadvantages of the above mentioned variations are; a sturdy structure, high production cost, large basic friction, force or restraining systems due to the characteristics of rotational machines, high current consumption, and loading that is dependent on the number of revolutions.

Of several known physiological loading units those distributed by MEDICOR-WERKE (unit KE21) should be mentioned. In this unit via a pedal drive and by means of a free wheel, a fly wheel mass and finally an electric motor of a specific structure is driven in brake operation. The electro-motor is connected to external control and loading circuits by means of which the desired load is adjusted, that is, the compensation for internal friction is accomplished, which may amount to 40 to 50 watts. The heretofore known devices are, although they perform their basic function, disadvantageous in that they are too heavy so that their handling and transport is made difficult and in that for compensating for the interior friction extensive solutions are required whose accuracy is not always sufficient.

It is, therefore, an object of the present invention to produce a physiological loading unit of the type mentioned above which is simple in structure and has a small inner friction.

The physiological loading unit according to the present invention comprises a shaft driven by the person to be examined, said shaft being provided with a free wheel, a transmission gear, a fly wheel mass which is coupled to the acceleration side of the transmission gear or with an electro motor in brake operation. External electrical control and loading circuits are connected to the electro motor. Furthermore, the drive shaft is connected via a free wheel to a drum wheel with internal gearing and the interior of which is provided with several intermediate gears of equal size and with equal number of teeth and which are evenly distributed along a circle. The intermediate gears are coupled to a pinion which is arranged on the drive shaft. The rotor of the electro motor is arranged on the internal shaft so that it simultaneously forms the fly wheel mass. The stator of the electro motor is located next to the drum wheel with interior gearing and carries a polyphase winding which is connected to the electric loading circuit. Furthermore, the rotor windings are connected to the external control circuit by means of sliding contacts. In order to achieve a better utilization of space the rotor is designed such that the iron core consists of two overlapping halves which are bent towards each other. In the space between the two halves the fly wheel mass and the rotor windings are located.

In an advantageous embodiment according to the present invention, the stator consists of an inner and an outer housing part as well as of an armature which is arranged between the same and connected by threaded spindles. The shafts of the follower gears are connected to the inner housing part.

The invention is illustrated, by way of example, in the accompanying drawings, in which.

Figure 1:
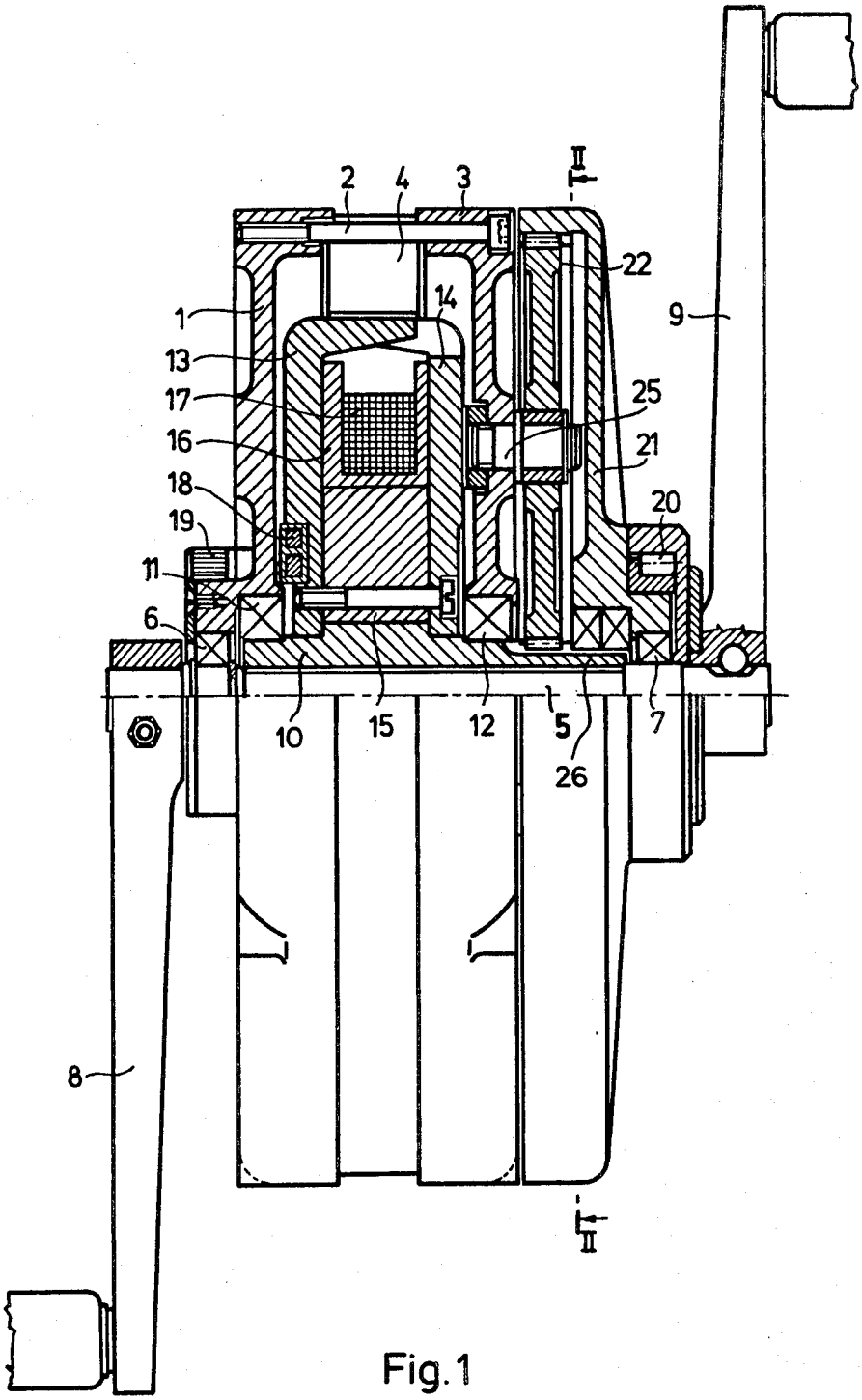
FIG. 1 is a composite of the physiological loading device, half in side view and half in section.

The physiological loading or stress-inducing device illustrated in FIG. 1 comprises a stator and a rotor connected thereto. The stator consists of a drum-shaped outer housing 1 which has an inner space, and of an inner housing 3 which is held by threaded spindles 2. A laminated armature 4 is arranged between the inner and outer housing 1, 3. The armature comprises crenellated spools and has a three-phase winding.

In the interior of the stator there is provided centrally a drive shaft 5 which is journalled in bearings 6, 7. The drive shaft 5 extends on both sides beyond the sidewalls and carries respective pedals 8 and 9. The drive shaft 5 is surrounded by an inner shaft 10 which is not directly coupled to the drive shaft 5 and which is journalled in a bearing 11 in the outer housing 1 and a bearing 12 in the inner housing 3.

The inner shaft 10 has on both sides a shoulder which is respectively confined by iron yokes 13, 14. The iron yokes 13, 14 are disc-shaped and are bent towards each other at their ends in the manner of a comb so that they form magnetic cores. In the space between the iron yokes 13, 14 there is located the fly wheel mass 15, the surrounding wound spool 16 and the rotor windings 17. The terminals of the windings of the rotor 17 are connected to sliding rings 18 and from which the carbon brushes 19 connected to the outer housing 1 receive the current. The rotor is driven by the pedals 8, 9 via the drive shaft 5. This drive shaft 5 is coupled via a free wheel 20 to a drum wheel 21. The free wheel 20 brings about that the drum wheel 21 receives a torque in one direction only so that no braking action is exerted onto the drum wheel 21 during rotation when the pedals are temporarily at a standstill.

Figure 2:
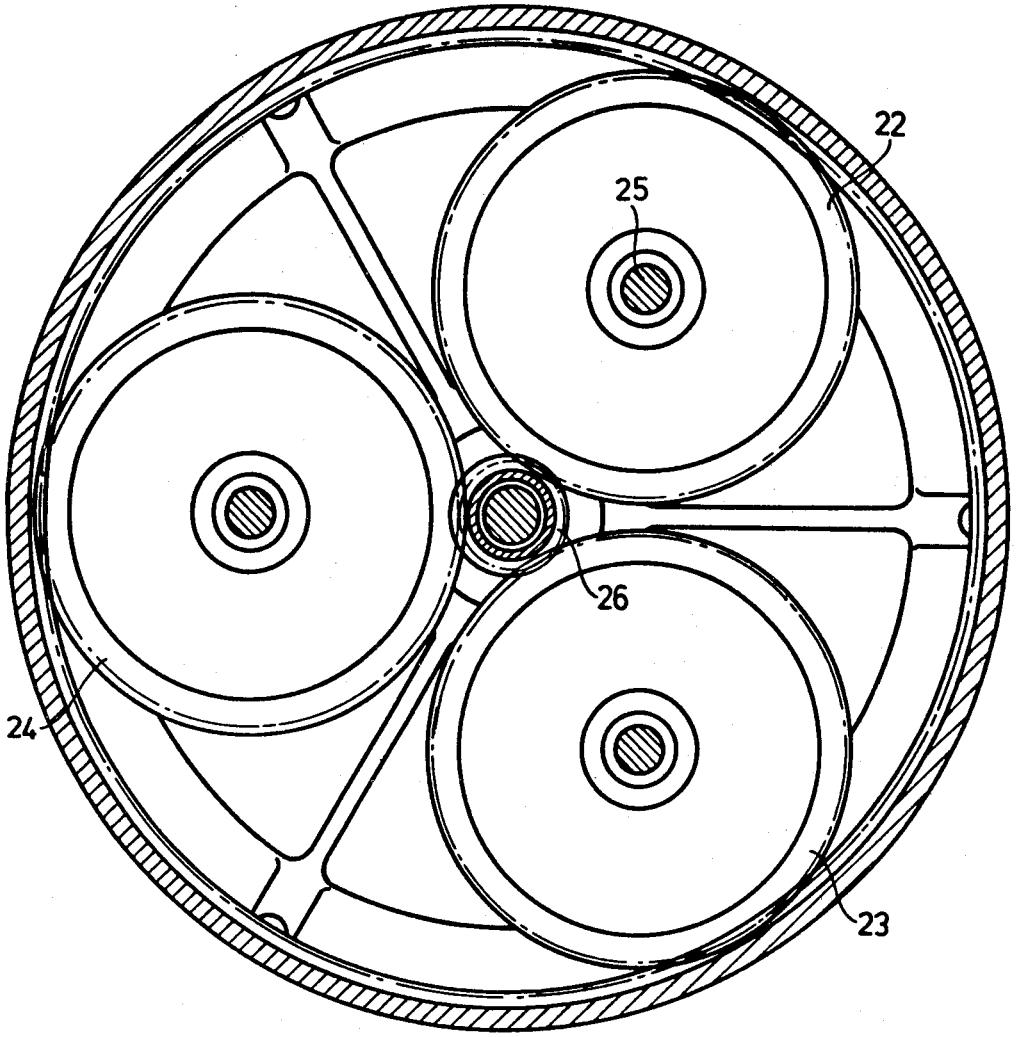
FIG. 2 is a section taken along line II—II of FIG. 1.

FIG. 2 shows in section the acceleration transmission gearing, arranged between the drum wheel 21 and the inner shaft 10. The drum wheel is provided with gear teeth along it inner margin. The gear teeth mesh with three follower pinions 22, 23, 24. These pinions are light plastic gears the supporting shafts of which are journalled at the inner housing 3. FIG. 1 shows the follower pinion 22 and its shaft 25. The supporting shafts for the follower pinions 22, 23, 24 are located at the tips of an equilateral triangle so that they are equally spaced from the inner shaft 10. This inner shaft 10 has gear teeth in the area 26 meshing with the teeth of the follower pinions 22, 23, 24 in order to achieve an accelerated rotation of the inner shaft 10 upon rotation of the drum wheel.

With the acceleration transmission gearing arranged as described above, only the torque is transmitted to the inner shaft since the radial compressive forces cancel each other out.

When operating the physiological loading apparatus according to the present invention, the person to be examined sets the rotor in the interior of the apparatus in rotation by means of the pedals 8, 9. The frictional loss of the entire drive amounts to approximately 4 to 5 watts, which represents a known constant and, therefore, can easily be added to the calculations. During the rotation of the rotor an exciting or energizing current is fed to the winding of the rotor 17 by a control unit (not shown) so that a three-phase voltage is induced in the windings due to the thus created magnetic field. The armature is connected to a braking unit (not shown) which is basically an adjustable resistor so that the physician can adjust the braking momentum. In the arrangement shown and described so far, the number of rotations can be varied within a range of from 20 to 100 revolutions per minute while the maximum output may amount to 600 watts. Due to the fact that the excitation and the load are independent of each other, the load can be adjusted in a stepless manner and independent of the number of revolutions.

The physiological loading apparatus according to the present invention is characterized by a very small volume compared to known apparatus of this kind of similar output. When comparing the loading apparatus it is important to note that the arrangement according to the present invention has an inner friction of only approximately 4 to 5 watts which is negligible compared to the frictional loss of from 40 to 50 watts for heretofore devices. Therefore, compensation by means of a separate control circuit is not required. Moreover, due to the particular design of the transmission gearing a uniform, smooth and almost noiseless rotation is guaranteed.

I claim:

1. Physiological loading device having a drive shaft to be driven by a person to be examined, a freewheel, a transmission gear, a fly wheel mass coupled to a dynamo-electric machine in brake operation with external control and loading circuits, characterized in that the drive shaft (5) is coupled via a freewheel (20) to a drum wheel (21) with internal teeth, the interior space of the wheel containing several follower pinions (22,23,24) equally distributed over a circle, and of equal size and number of teeth, said pinions are disposed for driving a toothed inner shaft (10) which is arranged about the drive shaft (5); the rotor of the dynamo-electric machine being connected to the inner shaft (10) and simultaneously functioning as a flywheel mass (15) the stator housing of the dynamo-electric machine being located adjacent the drum wheel (21) and supporting on its outside the shafts of said follower pinions and supporting on its inside a laminated armature (4) disposed around the rotor and carrying a polyphase winding which is connected to loading circuits or is provided with further rotor windings which are connected to external control circuits via collector rings (18).

2. A physiological loading device according to claim 1, characterized in that said rotor comprises two iron cores (13,14) which are disc-like bent towards each other and overlapping each other to form pole shoes, said flywheel mass (15) and said rotor windings (17) being arranged in the space between said two iron cores.

3. A physiological loading device according to claim 1 or 2, characterized in that the stator consists of an inner and outer housing part (1, 3) and of an armature (4) arranged therebetween and connected by threaded spindles (2), the shafts of the follower pinions (22,23,24) being fixed in the inner housing (3).

* * * * *